US005656129A

United States Patent [19]

Good et al.

[11] Patent Number: 5,656,129

[45] Date of Patent: Aug. 12, 1997

[54] METHOD OF PRODUCING FIBERS FROM A STRAW AND BOARD PRODUCTS MADE THEREFROM

[75] Inventors: David Benard Good, Pilot Rock; Leland Bruce Jones, Pendleton, both of Oreg.

[73] Assignee: Masonite Corporation, Chicago, Ill.

[21] Appl. No.: 455,690

[22] Filed: May 31, 1995

[51] Int. Cl.[6] ..... D21C 1/02; D01C 1/00

[52] U.S. Cl. ..... 162/13; 162/23; 162/97; 162/182

[58] Field of Search ..... 162/21–28, 27, 162/13, 17, 182, 187

[56] References Cited

U.S. PATENT DOCUMENTS

| | | | |
|---|---|---|---|
| 1,881,418 | 10/1932 | Lathrop et al. | 162/97 |
| 1,891,732 | 12/1932 | Sheperd | 162/97 |
| 1,941,350 | 12/1933 | Hawerlander | 162/97 |
| 2,145,851 | 2/1939 | Asplund . | |
| 2,164,192 | 6/1939 | Marcham et al. | 162/97 |
| 2,388,592 | 11/1945 | Asplund et al. | 162/97 |
| 2,676,884 | 4/1954 | Hamburg | 162/97 |
| 4,243,480 | 1/1981 | Hernandez et al. | 162/141 |
| 4,402,896 | 9/1983 | Betzner et al. | 264/115 |
| 4,451,322 | 5/1984 | Dvorak | 156/461 |
| 4,748,777 | 6/1988 | Glassco et al. | 52/82 |
| 4,879,850 | 11/1989 | Glassco et al. | 52/82 |
| 4,882,112 | 11/1989 | Maki et al. | 264/109 |

FOREIGN PATENT DOCUMENTS 3-164201 7/1991 Japan .

OTHER PUBLICATIONS

Encyclopedia Britannica, 11th ed., vol. XX, pp. 724–737 (1911).

*Primary Examiner*—Joseph W. Drodge
*Attorney, Agent, or Firm*—Marshall, O'Toole, Gerstein, Murray & Borun

[57] ABSTRACT

A method of refining wheat straw into fibers cuts the straw to a length of between about two and about four inches, wets the straw, softens the straw by subjecting the straw to pressurized steam and refines the softened straw in a pressurized mechanical refiner to produce fibers capable of being used in the manufacture of cellulosic board products. The straw fibers may be combined in any proportion to other fibers, such as wood fibers, and used in known dry, wet-dry, and wet board manufacturing processes to produce softboard, medium-density fiberboard, and hardboard products.

38 Claims, 1 Drawing Sheet

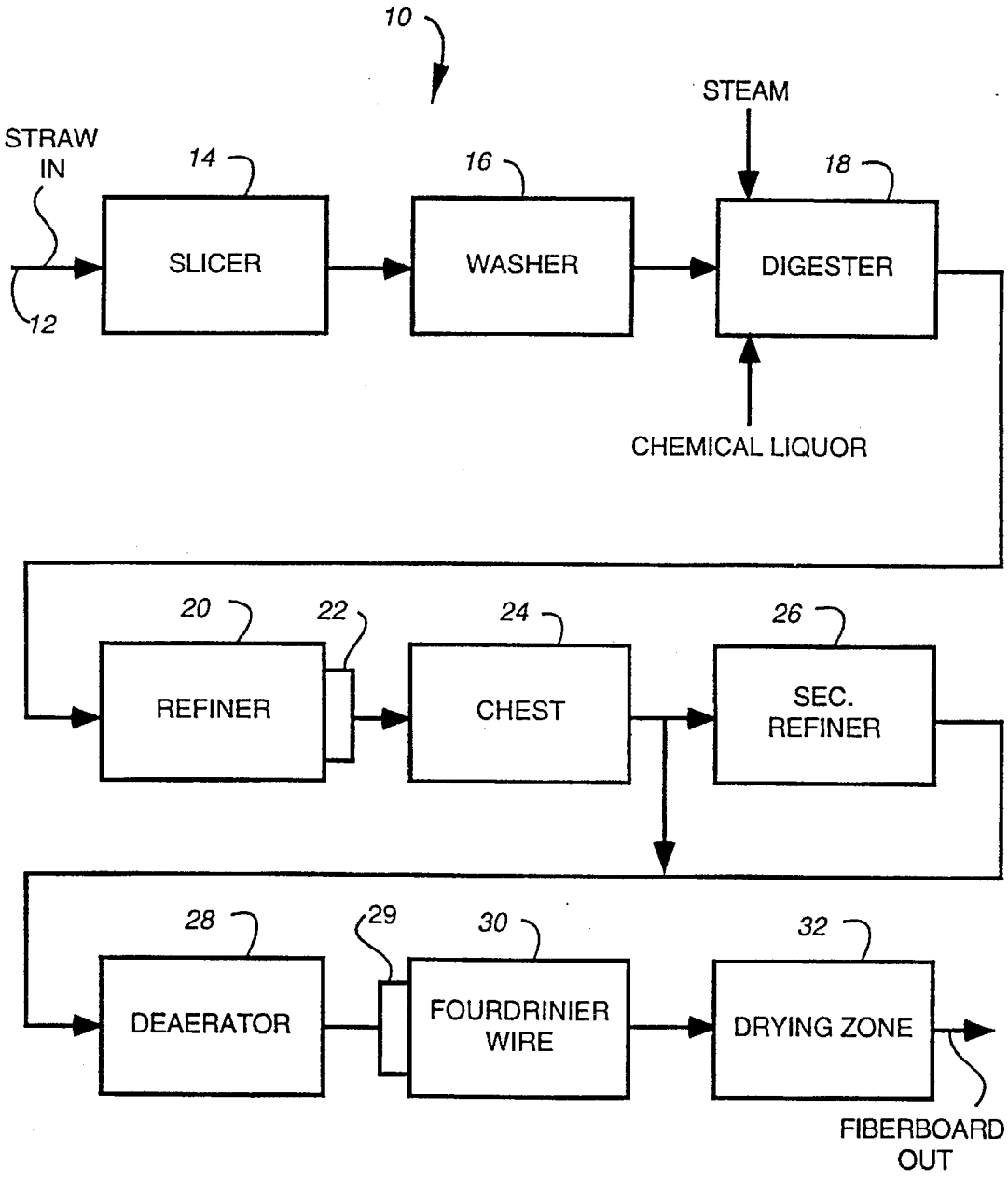
10
STEAM
STRAW IN
14
16
18
SLICER
WASHER
DIGESTER
12
CHEMICAL LIQUOR
20
22
24
26
REFINER
CHEST
SEC. REFINER
28
29
30
32
DEAERATOR
FOURDRINIER WIRE
DRYING ZONE
FIBERBOARD OUT

METHOD OF PRODUCING FIBERS FROM A STRAW AND BOARD PRODUCTS MADE THEREFROM

BACKGROUND OF THE INVENTION

1. Field of the Invention

The invention relates generally to the production of cellulosic materials using straw as a raw material and, more particularly, the invention relates to the production of man-made board products using wheat straw as furnish.

2. Description of Related Technology

Man-made board products are generally classified into three categories including softboard (having a density less than about 30 pounds per cubic foot), medium-density fiberboard (having a density between about 30 and about 45 pounds per cubic foot), and hardboard (having a density greater than about 45 pounds per cubic foot).

The principal processes for the manufacture of boards include (a) dry felted/dry pressed or "dry" processes, (b) wet felted/dry pressed or "wet-dry" processes, and (c) wet felted/wet pressed or "wet" processes. In a dry process, cellulosic fibers (e.g., woody material which has been subjected to fiberization to form wood fibers) are generally mixed with resins and conveyed in a gaseous stream or by mechanical means to a support structure to form a mat. The mat is then pressed to create a board product. More specifically, cellulosic fibers supplied from a fiberizing apparatus (e.g., a pressurized refiner) can be first coated with a thermosetting resin binder, such as a phenol-formaldehyde resin, in a blowline blending procedure. The resin-coated fibers from the blowline can then be randomly formed into a mat by air blowing the fibers onto a support member. The fibers, either before or after formation of the mat, can optionally be subjected to pre-press drying, e.g., in a tube-type dryer. The mat, typically having a moisture content of less than 30 weight percent (wt.%), and preferably less than 10 wt.%, is then pressed under heat and pressure to cure the thermosetting resin and to compress the mat into an integral consolidated structure.

In blowline blending, which takes place between the fiberizing apparatus and the pre-press dryer, the binder resin (generally saturated with steam from the fiberizing apparatus) is blended with the fiber using air turbulence. Blowline blending offers several advantages, including ease, quality, and efficiency of blending of the fibers and the binder resin. In many blowline processes, resins are applied to the wet fibers at about 200° F.–250° F. (e.g., approximately 230° F.), and then are passed into a dryer having an inlet temperature of about 320° F. to about 400° F. The inlet temperature depends upon dryer efficiency and/or the diameter of the dryer entry.

A typical wet-dry process begins by blending cellulosic fiber material in a vessel with large amounts of water having an acid or neutral pH (i.e., 7 or less) to form a slurry. This slurry is then blended with a resin binder and the blend is deposited onto a water-pervious support member, where a large percentage (e.g., 50 percent) of the water is removed through vacuum draining and press rolls, thereby leaving a wet mat of cellulosic material having a water content of about 40 wt.% to about 60 wt.%, based on the weight of the wet mat, for example. This wet mat is then transferred to a zone where much of the remaining water is removed by evaporation, preferably facilitated by the application of heat, to form a dried mat. The dried mat preferably has a moisture content of less than about 10 wt.%. The dried mat is then transferred to a press and consolidated under heat and pressure to form the wood composite which may be a flat board or a doorskin article, for example. The product can have any other desired shape, depending on the intended use of the product.

Generally, in a wet process, cellulosic fillers or fibers are blended in a vessel with large amounts of water to form a slurry. The slurry has sufficient water content to suspend a majority of the wood fibers and preferably has a water content of at least 90 wt.% and, most preferably 96 to 98.5 wt.%. The slurry is deposited along with a synthetic resin binder, such as phenol-formaldehyde resin, onto a water-pervious support member, such as a fine screen or a Fourdrinier wire, where much of the water is removed to leave a wet mat of cellulosic material having, for example, a moisture content of about 110 wt.%, based on the weight of dry cellulosic material. The wet mat is then consolidated under pressure and dried in a drying oven to form a wood composite.

Typically, the cellulosic fibers used in each of a dry process, a wet-dry process, and a wet process are produced from wood chips or other low quality forest residues. In forming these fibers, the wood chips or the residues are reduced to a fairly uniform size by chipping, sizing, and/or screening. The wood chips are then cleaned and softened using, for example, a steam thermal process. The softened wood chips are then mechanically refined in a refiner such as an atmospheric or pressurized refiner, which grinds and separates the softened wood chips to form the cellulosic fibers. However, with the depletion of natural wood resources, wood by-products, such as wood chips and other low-grade forest materials, are becoming increasingly more expensive and difficult to obtain. It is desirable, therefore, to use a readily obtainable and abundant material as a replacement for wood chips as furnish in the production of cellulosic materials like man-made board products.

Furthermore, boards made from wood products are usually very flammable. It is desirable, therefore, to replace the wood fibers normally used in board manufacturing processes with fibers that have a greater resistance to fire than the wood fibers.

Wheat straw, which is an abundant and renewable resource, has a number of inherent disadvantages as furnish in the production of cellulosic materials as compared to wood chips and other low-grade forest products. The hollow, tubular shape and waxy outer surface of wheat straw makes the straw less dense than most wood materials and, if not properly preconditioned, causes boards produced therefrom to have less than desirable strength. Furthermore, long strands of straw are undesirable during the board forming process because they tend to wrap around the components of the board manufacturing process which, in turn, causes frequent shut down of the process for cleaning. The cleaning process is labor intensive and interrupts continuous production of boards.

Nonetheless, wheat products, such as wheat straw, have been used as a raw material in some processes that typically rely on the use of wood products as raw materials. It is known, for example, to use straw in a paper-pulping procedure whereby the straw is broken down until completely delignated and formed into a cellulosic component for use in paper-making machines. Hernandez et al., U.S. Pat. No. 4,243,480 (Jan. 6, 1981), discloses a process of producing paper products using water-insensitive starch fibers made from any naturally occurring or fractionated starch, including wheat, to replace all or part of the cellulosic or other pulp conventionally employed in the paper-making process. In this process, the starch fibers are precipitated by the extrusion of a thread-like stream of a colloidal dispersion of starch at 5 wt.% to 40 wt.% solids into a moving, coagulating salt solution. The aqueous suspension of starch fibers produced by the mixture of the starch dispersion and the aqueous salt solution is introduced into the pulp stream of a paper-making process, thereby enabling production of fibers in the paper web. These processes of using wheat products are only applicable to paper-making procedures and, therefore, are considered inadequate for the production of board products.

It is also known to use straw in a dry process to produce particle board products. In such a process, the straw is chopped and/or mechanically ground and bound together with a resin to produce particle board. However, producing particle board having a straw content of greater than approximately 10 wt.% with a dry process usually produces a product which is vastly inferior in strength.

Dvorak, U.S. Pat. No. 4,451,322 (May 29, 1984), discloses a compacting apparatus for forming pressed sheets from crude plant fiber, such as straw from stalks of cereal grains. The fibrous material is first dried to have a moisture content of less than 15 wt.% and is stripped and broken down into small fibrous strains of substantially uniform diameter. The compacting apparatus includes a conveyor which transports the dried, cut fibrous material into a chute which, in turn, delivers the fibrous material to a compactor. The chute includes a plurality of arcuately reciprocating plungers which are serially arrayed along the flow path of the fibrous material and which precompact the fibrous material to have a uniform density as it is delivered to the compactor. In the compactor, a ram periodically operates to compact the fibrous material into a tunnel such that the fibrous material is formed into a continuous sheet having a uniform height and width. After exiting the tunnel, the sheet enters a press where heat and pressure are applied to the surfaces thereof to increase the mechanical interlinking of the individual fibers in the sheet. Surfacing material is bonded to the compacted sheet which can then be cut to any desired length.

These dry processes that use straw do not enable the production of board products using only or a majority of straw as a raw material. These processes may also require specialized and potentially expensive equipment. Furthermore, these processes are not applicable to certain board manufacturing techniques such as wet processes and wet-dry processes. In fact, none of these processes includes a method of refining straw into fibers capable of being used in the production of cellulosic materials in each of a dry process, a wet-dry process, and a wet process.

SUMMARY OF THE INVENTION

It is an object of the invention to overcome one or more of the problems described above.

The invention provides a method of refining straw, such as wheat straw, into fibers capable of being used in dry, wet-dry, and wet board manufacturing processes and a method of producing cellulosic materials, such as fiberboard, from fibers developed from wheat straw or from fibers developed from both wheat straw and other sources of fiber such as wood products.

According to the invention, a method of producing straw fibers capable of being used in the manufacture of cellulosic materials includes softening the straw with steam and refining the softened straw to produce the straw fibers.

Also according to the invention, a process for producing cellulosic materials from straw softens the straw with steam, refines the softened straw to produce straw fibers, and develops a cellulosic material from the straw fibers using, for example, a dry process, a wet-dry process, or a wet process.

Further objects and advantages of the invention will be apparent to those skilled in the art from the following detailed description and drawing, taken in conjunction with the appended claims.

DESCRIPTION OF THE DRAWING

The sole FIGURE is a block diagram of a fiberboard manufacturing process that uses straw as furnish to produce straw fibers and fiberboard materials according the invention.

DETAILED DESCRIPTION OF THE INVENTION

Referring to the FIGURE, a fiberboard manufacturing process using straw as furnish is illustrated. The process, generally designated 10, performs two general functions. Firstly, the process 10 breaks the straw down into individual fibers capable of being used in a dry process, a wet-dry process, or a wet process to produce cellulosic materials, such as fiberboards. Secondly, the process 10 produces cellulosic materials using the fibers developed from the straw. Although the process 10 is described herein as using wheat straw as furnish in a wet process in the production of softboard products, the process of producing cellulosic materials from straw is not limited to these aspects. In fact, it is believed that other types of straw, such as straw from other desired cereal grains, can be used in any desired process such as a dry process, a wet-dry process, or a wet process to produce softboard, medium density fiberboard and/or hardboard products according to one or more aspects of the invention.

Wheat straw, such as Steven's wheat straw, which has been cut and baled, is delivered to an input 12 of the process 10. Although the wheat straw can be delivered in any desired quantity such as 60-pound bales, it is preferable to deliver the wheat straw in 1,000-pound bales, 1,500-pound bales, or, most preferably, 3,000-pound bales in order to reduce the amount of manual labor required to unbundle and transport the wheat straw to the process input 12.

After the straw bales have been broken down to eliminate wires, strings, and other foreign objects, the straw is provided to a cutter or slicer 14 which slices or cuts the straw to a length of, preferably, between about two inches and about four inches. The slicer 14 may comprise a hammermill or other similar type of machine which forces the straw, via high impaction pressure, through a cutting screen. However, any other desired straw cutter can be used as the slicer 14.

One disadvantage of hammermill type machines is that these machines tend to produce large quantities of undesirable fines, i.e., very short pieces of straw and straw dust. It is preferable to eliminate or reduce the amount of fines produced in the cutting process because fines can not be refined into fibers useful in the manufacture of board products. It is believed that the straw slicer currently manufactured by Cormall Ltd., a Danish corporation, will be suitable for use in cutting the straw to a two inch to a four inch length without producing large quantities of undesirable fines. Generally, this slicer includes three sets of fluted rolls that orient straw lengthwise and a set of rotating blades that cut the straw to a predetermined length.

As noted above, it is preferable to cut the straw to a length between about two inches and about four inches. However, the straw can be cut to other desired lengths wherein the minimum length of straw will be determined by the strength requirements of the board product being produced while the maximum length of the straw will be a determined as a function of how well the straw travels through the components of the fiberboard manufacturing process 10.

After being cut to the desired length, the cut straw is provided to a washer 16 which washes the straw with water to remove fines and to eliminate any retained foreign objects, such as dirt and stones, which are detrimental to refining equipment and the final board product. The washer 16 may include a rippled surface over which the straw and water travel, wherein heavy foreign objects, such as rocks and stones, are trapped in the valleys of the ripples while dirt is washed away by the water.

In the washing process, the washer 16 wets the straw which is advantageous during subsequent refining steps. Although the washer 16 can wet the straw to any desired moisture content, it has been found that wetting the straw to have a moisture content of between about 15 wt.% and about 50 wt.% is preferable and produces the best results in the final board product produced using straw as furnish.

While the steps of cutting and wetting the straw are preferable in the manufacture of fiber from straw, these steps are not necessary to produce fiber from straw according to the invention or to produce boards using straw as furnish according to the invention.

After being wetted in the washer 16, the straw is delivered to a digester 18 which softens the straw before delivering the straw to a refiner 20. Preferably, the digester 18 comprises a continuous digester which may be either horizontally or vertically oriented but, alternatively, may comprise any other type of digester, such as a batch digester. Typically, a continuous digester includes a screw-type auger that moves the straw through a steam tube wherein pressurized steam is injected into the straw to soften the straw.

In a preferred embodiment, the steam tube is approximately 40 feet long and steam is injected into the tube near or at the location at which the straw is injected into the tube. During operation of the digester 18, it is preferable to keep the straw flowing through the steam tube in a manner that causes the straw at the ends of the steam tube to act as plugs which keep the pressurized steam within the steam tube.

Preferably, steam is applied to the wheat straw at pressure of between about 30 psig and about 100 psig although any desired pressure can be used. Most preferably, the steam is applied to the wheat straw at pressure of between about 40 psig and about 75 psig. The straw can remain within the steam tube anywhere between about 30 seconds and about 20 minutes (or longer, if desired). It is preferable, however, to keep the dwell time of the straw within the steam tube between about 30 seconds and about two minutes. Generally speaking, the longer the straw is subjected to steam within the steam tube, the softer the straw becomes and the more the straw can be refined. More refining of the straw, in turn, enables the production of more dense board materials.

If desired, one or more chemicals can be mixed with the wheat straw within the steam tube of the digester 18 to soften the straw further and to enhance the breakdown of the straw into separate fibers. Any chemical which softens the lignin portion of the straw can be used. The chemical can be sprinkled in dry form on the straw or mixed with water and added to the straw. It has been found that adding sodium carbonate preferably at about 0.08 to 0.1 wt.% based on the weight of bone-dry straw produces good results. Alternatively or in addition, any other desired chemical(s) can be added to the straw in any desired proportion within the digester 18. However, because straw has a relatively weak bonding structure, only very low chemical concentrations should be used within the steam tube, if at all.

After exiting the digester 18, the digested or softened straw is preferably immediately provided to the refiner 20 that produces individual fibers from the straw. The refiner 20 preferably comprises a pressurized mechanical refiner such as a Sunds Defiberater or an Andritz-Sprots Bauer refiner but may, alternatively, comprise an atmospheric refiner such as an atmospheric Bauer refiner or any other desired type of mechanical or chemical refiner. If the refiner 20 is a pressurized refiner, it is preferably coupled directly to the output of the digester 18 and is pressurized to the pressure of the steam used in the digester 18. Typically, mechanical refiners include one or more circular plates having patterns or channels engraved on the surfaces thereof that rotate with respect to one another. The digested straw is provided through the center of the plates to a space between the plates and is then refined into individual fibers by coming into contact with the rotating plates while being forced to the outer periphery of the rotating plates. In a multiple-plate configuration, the amount of refining performed on the straw, i.e., the refining intensity, is determined by how closely the plates are spaced together.

If the refiner 20 is a pressurized refiner, pressurized steam is also provided to the space surrounding the plates to further enhance the refining process. In such an embodiment, the steam is preferably provided to the refiner 20 at a pressure of between about 30 psig and about 100 psig and, most preferably, at a pressure of between about 40 psig and about 75 psig, although any other desired pressure can be used. In the preferred embodiment, extremely low refining intensities of between about 500 kWh and about 1500 kWh per ton of bone-dry straw are used within the refiner 20 in order to avoid over refining the straw. However, other desired refining intensities can also be used to enable the refiner 20 to produce fibers capable of being manufactured into board products. Generally speaking, the greater the refining intensity used, the more refined the straw fibers output by the refiner 20 become, and the more dense the board products produced from the straw fibers will be.

Straw fibers exit the refiner 20 through a blow valve 22, are washed, and are then delivered, at atmospheric pressure, to a chest 24 which collects the straw fiber. Board products may be produced from the straw fiber developed by the refiner 20 using methods similar or equivalent to known methods of producing board products from wood fibers including wet processes, wet-dry processes, and dry processes. However, wet processes and wet-dry processes may need to be altered to account for the slower draining characteristics of straw fiber. For example, it may be desirable to eliminate the step of washing the straw fibers produced by the refiner 20 and/or it may be desirable to blend the straw fibers produced by the refiner 20 with faster draining wood fibers to speed the drying of board products made from straw fibers in wet processes and wet-dry processes.

In the process of developing board products, the straw fiber may be combined in any desired proportion to fiber developed from one or more other sources of fiber including, but not limited to, wood chips and other wood products, waste paper, and fibrous plants like rice, jute, and hemp. The straw fiber and other fiber combination may also be used according to any suitable method to produce cellulosic materials. If such a fiber combination is used in a wet process, it is preferable to mix the different types of fibers consistently throughout the slurry used in that process, i.e., to assure that the fibers are evenly blended. This mixing may be accomplished through the use of a cyclone agitator that mixes the straw fibers and the other fibers with water until the fiber content of the mixture is, e.g., about 4 wt.%. The agitator vigorously agitates this mixture to blend the fibers evenly throughout the mixture and delivers the blended fiber/water mixture to the chest 24.

In a wet process that produces softboard products, the straw fiber or the straw and other fiber combination is diluted with water in the chest 24 to form a slurry such that, preferably, the percentage of fiber within the slurry is less than about 6 wt.% and, most preferably, less than about 4 wt.%. The chest 24 may include one or more pumps for adding water at a predetermined and measured rate to achieve the desired slurry. The slurry is then pumped from the chest 24 and diluted with more water via appropriate pumps until the slurry contains between about 1.5 wt.% and about 3 wt.% fibers. The fiber mixture is diluted with water in this manner to allow the individual straw and other fibers to orient smoothly and evenly, i.e., to avoid clumping of the fibers.

Any desired starches, waxes and/or asphalt emulsions can be added to the fiber slurry at the output of the chest 24 via appropriate pumps in any known manner and proportions. In hardboard manufacturing processes, linseed oil and/or other resins can also or alternatively be added to the fiber slurry output by the chest 24. If desired, papermakers' alum (aluminum sulfate) or, in a hardboard manufacturing process, ferric sulfate, can also be added to the slurry output by the chest 24 to increase the binding effect between the fibers during subsequent drying processes, i.e., to hold the starches and waxes together in the board product produced from the slurry. Papermakers' alum is also added to the slurry output by the chest 24 to decrease the pH of the slurry to be within a desired range, as is known in the art.

The straw or straw and other fiber slurry can be provided to a secondary refiner 26 for further refining, although this step is not required. The secondary refiner 26 may comprise any suitable type of refiner that refines slurry materials including an atmospheric refiner, a pressurized refiner, or a pump-through refiner.

The slurry from the chest 24 or from the secondary refiner 26 is then provided to a deaeration machine 28 (such as that known in the art as a Deculator) that removes entrained air from the slurry by boiling the slurry in a vacuum. This procedure quickens the water removal during the initial board forming process. The deaerator 28 delivers the slurry through a headbox 29 onto a moving wire screen, such as Fourdrinier wire 30, which removes the water from the slurry.

Specifically, the Fourdrinier wire 30 first allows water to freely drain from the slurry. Next, water is vacuumed from the slurry to form a wet fiber mat that is then mechanically pressed with rollers and transported to a drying zone 32, such as a drying oven, where the moisture content is still further reduced by heating. As the mat leaves the drying zone 32, the moisture content is preferably reduced to be less than 3 wt.%.

In a hardboard production process, the dried mat may be placed in a press where the mat is pressed under heat to produce the molded wood composite. Preferably, the pressing temperature of such a press is greater than about 400° F., and most preferably, the pressing temperature is greater than about 430° F., but low enough to prevent combustion of the fiber, as is known in the art.

The dried mat produced by the drying zone 32 or the press may then be transported for cutting, coating, gluing or other finishing processes to complete a desired product for commercial use.

Preferably, the pH of the straw or straw and other fiber slurry is controlled to be between about 3 and about 7 and, most preferably, between about 4 and about 6.5, at all points throughout the board forming process. To accomplish this pH control, papermakers' alum can be provided to the fiber slurry at any point along the board manufacturing process in order to decrease the pH of the mixture. If necessary, bases such as sodium carbonate and sodium hydroxide can be added to the fiber slurry to increase the pH of the slurry.

As indicated above, board products can be made from fibers developed solely from wheat straw or, alternatively, can be made from any desired straw fiber and other fiber combination. It is believed that board products made from straw fiber developed according to the present invention is more resistant to fire than board products made from wood fiber. Generally speaking, board products with a higher straw fiber to wood fiber ratio will have a greater resistance to fire.

As noted above, it is believed that the process of manufacturing boards from straw can be accomplished using other types of straw besides wheat straw including, for example, grain and cereal straws. Moreover, although the process of preparing and using straw as furnish for board products has been described herein for the production of softboard products, it is contemplated that straw fibers developed according to the process disclosed herein can also be used in the production of medium-density fiberboard and hardboard products, except that the straw may need to be softened and/or refined to a greater extent.

The foregoing description is given for clearness of understanding only, and no unnecessary limitations should be understood therefrom, as modifications within the scope of the invention will be apparent to those skilled in the art.

We claim:

1. A method of producing fibers capable of being used in the manufacture of cellulosic fiberboard products from straw comprising the steps of:

cutting the straw to a length of about two inches to about four inches;

softening the straw by contacting the straw with steam under elevated pressure for a period of time between 30 seconds and two minutes; and mechanically refining the softened straw to produce fibers capable of being used in the manufacture of cellulosic fiberboard products.

2. The method of claim 1 wherein the straw comprises wheat straw.

3. The method of claim 1 further comprising the step of wetting the straw by contacting the straw with liquid water prior to the step of softening the straw.

4. The method of claim 3 wherein the step of wetting the straw comprises wetting the straw to have a moisture content of between about 15 wt.% and about 50 wt. %.

5. The method of claim 1 wherein the straw is contacted with steam at a pressure of between about 30 psig and about 100 psig.

6. The method of claim 1 wherein the straw is contacted with steam at a pressure of between about 40 psig and about 75 psig.

7. The method of claim 1 wherein the step of contacting the straw with steam under pressure includes the step of mixing the straw with a chemical softener.

8. The method of claim 7 wherein the step of mixing the straw with a chemical softener includes mixing the straw with sodium carbonate.

9. The method of claim 1 wherein the step of mechanically refining the straw includes the step of subjecting the straw to steam at a pressure of between about 30 psig and about 100 psig.

10. The method of claim 1 wherein the step of mechanically refining the straw includes the step of subjecting the straw to steam at a pressure of between about 40 psig and about 75 psig.

11. The method of claim 1 wherein the step of mechanically refining the straw includes the step of refining the straw at an intensity of between about 500 kWh and about 1500 kWh per ton of bone-dry straw.

12. A method of producing fibers from wheat straw wherein the fibers are capable of being used in the manufacture of cellulosic fiberboard products comprising the steps of:

cutting the wheat straw;

wetting the wheat straw by contacting the straw with liquid water;

softening the wheat straw by contacting the straw with steam under elevated pressure for a period of time between 30 seconds and two minutes after said wetting step; and mechanically refining the softened wheat straw at an intensity of between about 500 kWh and about 1500 kWh per ton of bone-dry straw to produce fibers capable of being used in the manufacture of cellulosic fiberboard products.

13. The method of claim 12 wherein the step of cutting the wheat straw includes cutting the wheat straw to a length between about two inches and about four inches.

14. The method of claim 12 wherein the step of wetting the wheat straw comprises wetting the wheat straw to have a moisture content of between about 15 wt.% and about 50 wt.%.

15. The method of claim 12 wherein the step of contacting the wheat straw with steam under pressure includes subjecting the wheat straw to steam at a pressure of between about 30 psig and about 100 psig.

16. The method of claim 2 wherein the step of contacting the wheat straw with steam under pressure includes subjecting the wheat straw to steam at a pressure of between about 40 psig and about 75 psig.

17. The method of claim 12 wherein the step of softening the wheat straw includes the step of mixing the wheat straw with a chemical softener.

18. The method of claim 12 wherein the step of mechanically refining the wheat straw includes the step of subjecting the wheat straw to steam at a pressure of between about 30 psig and about 100 psig.

19. A method of producing a cellulosic fiberboard from straw comprising the steps of:

cutting the straw;

wetting the straw with water;

softening the straw by contacting the straw with steam pressurized to between about 30 psig and about 100 psig for a period of time between about 30 seconds and about two minutes;

refining the softened straw to produce straw fibers; and producing a cellulosic fiberboard product from the straw fibers.

20. The method of claim 19 wherein the straw comprises wheat straw.

21. The method of claim 19 wherein the step of cutting the straw includes cutting the straw to a length of between about two inches and about four inches.

22. The method of claim 19 wherein the step of wetting the straw comprises wetting the straw to have a moisture content of between about 15 wt.% and about 50 wt. %.

23. The method of claim 19 wherein the step of softening the straw includes contacting the straw with steam pressurized to between about 40 psig and about 75 psig.

24. The method of claim 19 wherein the step of contacting the straw with steam under pressure includes the step of simultaneously subjecting the straw to a chemical softener.

25. The method of claim 19 wherein the step of refining the straw comprises the step of mechanically refining the straw.

26. The method of claim 25, wherein the step of mechanically refining the straw includes subjecting the straw to steam at a pressure of between about 30 psig and about 100 psig.

27. The method of claim 25 wherein the step of mechanically refining the straw includes refining the straw at an intensity of between about 500 kWh and about 1500 kWh per ton of bone-dry straw.

28. The method of claim 25 wherein the step of producing the cellulosic fiberboard product includes the step of mixing the straw fibers with water to form a slurry.

29. The method of claim 28 wherein the step of producing the cellulosic fiberboard product includes the steps of drying the slurry to form a wet mat and drying the wet mat to form the cellulosic board product.

30. The method of claim 28 further including the step of mixing fibers produced from another source of fiber with the straw fibers.

31. The method of claim 28 wherein the step of producing the cellulosic fiberboard product includes the step of controlling the pH of the slurry to be between about 4 and about 6.5.

32. The method of claim 28 wherein the step of mixing the straw fibers with water to form a slurry includes the step of mixing the straw fibers with water to form a slurry having about 1.5 wt.% to about 3.0 wt.% fiber content.

33. The method of claim 19 wherein the step of producing the cellulosic fiberboard product comprises producing a softboard material.

34. The method of claim 19 wherein the step of producing the cellulosic fiberboard product comprises producing a hardboard material.

35. The method of claim 19 wherein the step of producing the cellulosic fiberboard product comprises producing a medium-density fiberboard material.

36. The method of claim 19 wherein the step of producing the cellulosic fiberboard product includes the step of using a wet process to develop the cellulosic fiberboard product.

37. The method of claim 19 wherein the step of producing the cellulosic fiberboard product includes the step of using a wet-dry process to develop the cellulosic fiberboard product.

38. The method of claim 19 wherein the step of producing the cellulosic fiberboard product includes the step of using a dry process to develop the cellulosic fiberboard product.

* * * * *